US005196298A

United States Patent [19]

Meeus et al.

[11] Patent Number: 5,196,298

[45] Date of Patent: Mar. 23, 1993

[54] PHOTOGRAPHIC DEVELOPING SOLUTION CONTAINING AN ASCORBIC ACID DERIVATIVE

[75] Inventors: Pascal F. Meeus, Turnhout; Peter M. Willems, Stekene; Gino L. De Rycke, Mortsel, all of Belgium

[73] Assignee: AGFA-Gevaert, N.V., Mortsel, Belgium

[21] Appl. No.: 831,509

[22] Filed: Feb. 5, 1992

[30] Foreign Application Priority Data

Feb. 14, 1991 [EP] European Pat. Off. ..... 91200311.8

[51] Int. Cl.[5] ..... G03C 5/24

[52] U.S. Cl. ..... 430/440; 430/435; 430/446; 430/464; 430/483; 430/490

[58] Field of Search ..... 430/435, 440, 446, 464, 430/480, 483, 490

[56] References Cited

U.S. PATENT DOCUMENTS

| | | | |
|---|---|---|---|
| 2,688,549 | 9/1954 | James et al. | 430/483 |
| 3,730,727 | 5/1973 | Olivares et al. | 430/483 |
| 3,770,446 | 11/1973 | Sato et al. | 430/556 |
| 3,826,654 | 7/1974 | Weiss et al. | 430/483 |
| 3,938,997 | 2/1976 | Finch et al. | 430/483 |
| 5,098,819 | 3/1992 | Knapp | 430/483 |

*Primary Examiner*—Hoa Van Le
*Attorney, Agent, or Firm*—Breiner & Breiner

[57] ABSTRACT

A photographic developing solution for immersion development is disclosed showing a pH of at least 12.0 and containing more than 0.4 moles/liter of a sugar derivative, or an alkali metal salt thereof, corresponding to general formula (I):

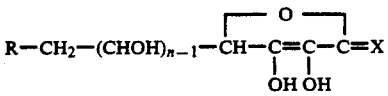

(I)

wherein X represents an oxygen atom or an imino group, and n represents a positive integer from 1 to 4, and R represents a hydroxy group when n is 1, and R represents a hydroxy group or a hydrogen atom when n is 2 to 4.

Preferred sugar derivatives according to the present invention are l-ascorbic acid and iso-ascorbic acid. In a most preferred embodiment there are substantially no other developing agents and no sulphite ions present. When developing a graphic arts photographic material lith quality is obtained. The disposal of depleted solutions can be performed in an ecologically safe way.

13 Claims, No Drawings

PHOTOGRAPHIC DEVELOPING SOLUTION CONTAINING AN ASCORBIC ACID DERIVATIVE

FIELD OF THE INVENTION

The present invention relates to photographic developers and more particularly to photographic developers for immersion processing containing an ascorbic acid derivative at a high concentration and a high pH.

BACKGROUND OF THE INVENTION

The developing activity of 1-ascorbic acid (vitamine C) and some chemical analogues is known since many years in the photographic art. In their report on the synthesis of iso-ascorbic acid (iso-vitamine C or d-arabo-ascorbic acid) in Berichte, Vol.67, p. 1239 (1934) Maurer at al. for the first time report tests on ascorbic acid and its optical isomer as developers for a photographic plate and describe them as active developers superior to conventional aromatic developers. However in most later studies ascorbic acid and derivatives are regarded as rather weak developers by themselves. So there are several publications on developers containing a superadditive combination of a conventional developing agent and an ascorbic acid derivative used as auxiliary developer or as an antioxidant. U.S. Pat. No. 2,688,549 discloses the combination of a 3-pyrazolidone developing agent and of an ascorbic acid derivative. GB 1 266 533 describes the combination of a p-hydroxybenzene developing agent, an ascorbic acid and sulphite ions. An equally good developing activity for both surface and internal latent images is claimed in U.S. Pat. No. 3,826,654 which discloses a combination of a 3-pyrazolidone an ascorbic acid, a heterocyclic thione or thiol and an alkali iodide at a pH of at least 12. The concentration of the ascorbic acid ranged from 0.05 moles to 0.4 moles per liter. The most preferred pH range was 13 to 14.

Several compositions specifically for high contrast development are published. So U.S. Pat. No. 3,942,985 discloses the combination of an iron chelate developer and an ascorbic acid. U.S. Pat. No. 4,756,997 claims a combination of a p-hydroxybenzene, an auxiliary developer an antifoggant, an antioxidant and an -ketocarboxylic acid wherein the antioxidant can be ascorbic acid.

An application wherein ascorbic acid is the principal developing agent is disclosed in the Japanese Unexamined Patent Publication (Kokai) 59-191035 the reduction or omission of the washing step in the processing cycle is claimed as unexpected advantage. The concentration of ascorbic acid ranges from 0.2 to 20 g/l in case of immersion processing and from 0.5 to 1OO g/l in case of coating development. A pH of 10 to 12 is preferred for immersion processing and of 11 to 14 for coating types of development.

Chemical analogues of ascorbic acid that show developing activity too include (iso)ascorbic acid ketals or acetals as disclosed in GB 1 142 135, dihydroxyfuran derivatives as described in *J. Phot. Sci.*, Vol. 19 (1971), p. 211, and imino-ascorbic acid derivatives as claimed in U.S. Pat. No. 2,688,548.

A first study on the kinetics of development by ascorbic acid by T. H. James was published in *J. Am. Chem. Soc.* Vol. 66 (1), p. 91 (1944). The results of a more extensive study by Willis and Pontius appeared in *Phot. Sci. Eng.* Vol. 14 (6), p. 384 (1970). The autors concluded to a two step mechanism including an induction period and a continuation step with different activation energies.

In graphic and reprographic arts the accurate sharp reproduction of line edge and screen dot originals is of uttermost importance. This goal is reached by the combination of specially designed graphic arts materials and appropriate processing systems producing so-called "lith quality". A first group of such processing systems consists of the traditional "lith developers" characterized by the presence of hydroquinone as the sole developing agent and a low sulphite ions content giving rise to an infectious development mechanism. However these conventional developers are rather instable in time and require complicated regeneration systems for both oxidation and exhaustion. In more recent times so-called "hard dot Rapid Access" developers were introduced on the market which combine a good stability with a "lith quality" in the reproduction of edges and screen dots. Examples of such developers and corresponding appropriate photographic materials include the GRANDEX system, marketed by FUJI PHOTO Ltd. AGFASTAR, marketed by AGFA-GEVAERT N.V. and the ULTRATEC system, marketed by EASTMAN KODAK Co. However all these developer systems show some disadvantages from an ecological or toxicological point of view. E.g. hydroquinone is a rather unwanted ingredient because of its allergenic effects. The biodegradation of disposed Phenidone is too slow. Sulphite ions show a high COD (Chemical Oxygen Demand) and the resulting sulphate ions are harmful for e.g. concrete. As a consequence it is undesirable that depleted solutions of this kind would be discharged into the public sewerage; they have to be collected and destroyed by combustion, a cumbersome and expensive process. As a consequence residual solutions containing sulphite produce emissions containing sulphurdioxide and/or sulphurtrioxide on combustion. On the other hand, some "hard dot Rapid Access" systems are ecologically suspect due to the presence of hydrazine or hydrazide derivatives and/or the presence of amino compounds which can be toxic or too volatile as stated in U.S. Pat. No. 4,975,354. It is possible that unwanted organic solvents are used in order to introduce some water insoluble compounds into the photographic material. Some of these suspect compounds can be washed out partially on development. So there is a permanent need for developing solutions which can be disposed of in a safer way for the environment and which are more consumer-friendly.

In a few cases ascorbic acid is described as showing some activity as a "lith developer". In his study on the mechanism of lith development, published in *J. Phot. Sci.* Vol. 27 (1979), p. 185, Zwicky shows that a lith effect can occur with ascorbic acid as the sole developing agent and he illustrates the effect with photographs showing reproduced line edges and contact screen dots. The developing solution employed contained 112 g of ascorbic acid per liter, potassium bromide, formaldehyde bisulphite and sodium hydroxide to establish a pH of 10.5. However even with this high concentration of ascorbic acid the rate of formation of developed silver was considerably slower compared to a conventional hydroquinone lith developer. As a result the slope of the characteristic or sensitometric curve was appreciably lower than with hydroquinone. Eventually no commercially usable developer resulted from Zwicky's formula.

In Miller U.S. Pat. No. 3,386,824 a processing solution of high pH containing a high concentration of iso-ascorbic acid is disclosed. However this solution is embedded in plastic micro-capsules and not intended for conventional immersion processing.

It is an object of the present invention to provide a processing solution which can be treated after use in a safe way for the environment and which use is more consumer-friendly.

It is a further object of the present invention to provide a processing solution of a simple composition for immersion processing and easy to replenish that produces hard dot quality as an alternative to existing lith developers and hard dot Rapid Access developers.

Further objects will become apparent from the description hereafter.

SUMMARY OF THE INVENTION

The objects of the present invention are realized by a developing solution for immersion development showing a pH of at least 12.0 and containing more than 0.4 moles/liter of a sugar derivative, or an alkali metal salt thereof, corresponding to general formula (I):

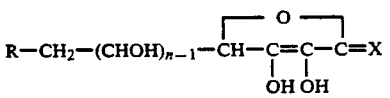

(I)

wherein X represents an oxygen atom or an imino group, and n represents a positive integer from 1 to 4, and R represents a hydroxy group when n is 1, and R represents a hydroxy group or a hydrogen atom when n is 2 to 4

Preferred sugar derivatives according to the present invention are l-ascorbic acid and iso-ascorbic acid. In a most preferred embodiment there are substantially no other developing agents and no sulphite ions present.

It was shown experimentally that a developing solution of this simple composition surprisingly produces a far better lith quality on development of graphic arts photographic materials than the composition described by Zwicky, cited above.

It is possible to dispose of used up developing solutions according to the invention in a safe way for the environment as will be explained in the detailed description following hereafter.

DETAILLED DESCRIPTION OF THE INVENTION

Sugar derivatives corresponding to general formula (I) and usable in the developing solutions according to the present invention include following compounds:

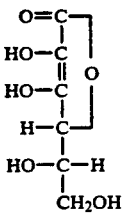

(I-1)

l-ascorbic acid

-continued

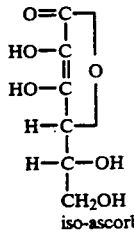

(I-2)

iso-ascorbic acid

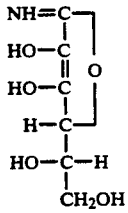

(I-3)

imino-l-ascorbic acid

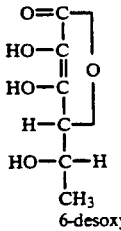

(I-4)

6-desoxy-l-ascorbic acid

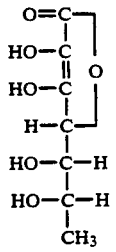

(I-5)

l-rhamnoascorbic acid

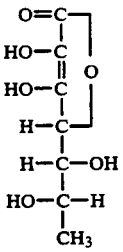

(I-6)

l-fucoascorbic acid

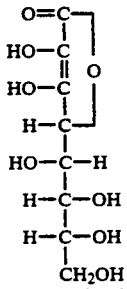

(I-7)

d-glucoheptoascorbic acid

-continued

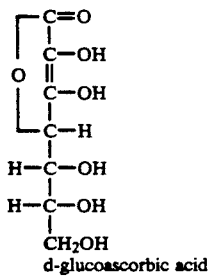

(I-8)

d-glucoascorbic acid

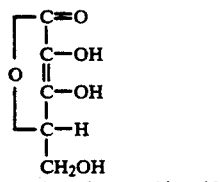

(I-9)

l-erythroascorbic acid

The sugar derivatives of this invention are preferaby present in a concentration ranging from 0.45 to 0.90 moles per liter. Preferred compounds for application in the present invention are l-ascorbic acid and iso-ascorbic acid. These compound can be dissolved into the developing solution in their free acid form alternatively they can be incorporated as an alkali salt, preferably the sodium or potassium salt or a mixture of both. In case of the latter method a lower amount of alkali hydroxide is needed to establish a pH of at least 12.0.

In a preferred embodiment of the present invention an alkali bromide salt, e.g. potassium bromide is present in the developing solution preferably in a concentration ranging from 0.05 moles to 0.8 moles per liter and most preferably in a range from 0.1 to 0.4 moles per liter.

In an other preferred embodiment of the present invention at least one so-called antifogging agent or stabilizer is present in the developing solution. Numerous chemical classes of stabilizers are known in the photographic art. Suitable examples are e.g. the heterocyclic nitrogen-containing compounds such as benzothiazolium salts. nitroimidazoles, nitrobenzimidazoles, nitroindazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, mercaptopyrimidines mercaptotriazines, benzothiazoline-2-thiones and oxazolinethiones. In a preferred embodiment of the present invention the antifogging agent is a mercapto-group containing heterocyclic substance and most preferably it is 1-phenyl-5-mercapto-tetrazole preferably in a concentration range from 10 mg/l to 1 g/l and most preferably in a range from 20 to 250 mg/l.

The rather high pH values in connection with the present invention can be established by means of conventional buffering agents but preferably for ecological reasons the pH is simply established by the presence of an alkali hydroxide, e.g. sodium or potassium hydroxide. The full benefits of this invention are obtained in a pH range from 12.3 to 13.5.

Other adjuvants well known to those skilled in the art may be added to the developer liquid of the present invention. A survey of conventional developer addenda is given by Grant Haist in "Modern Photographic Processing"—John Wiley ans Sons—New York (1979) p. 220–224. Examples of such addenda include complexing agents for calcium and magnesium ions, present in hard water, e.g. ethylene diamine tetraacetic acid and analogues compounds. Further can be present anti-foaming agents, surface-active agents, biocides, thickening agent$ like polystyrene sulphonate and antioxidants like benzoate and cyclodextrine. The developing liquid can contain so-called anti-sludge agents in order to reduce dirt streaks on developed photographic material. Finally the solution can contain development accelerating agents like polyalkyleneoxides and alkonolamines and hardening agents including latent hardeners.

To achieve the optimal sensitometric and dot quality results of the present invention there is no need for a second auxiliary developing agent. Sulphite ions too can be omitted without detrimental effect on stability. So in a most preferred embodiment of the invention there are substantially no second developing agent and no sulphite ions present in the developer liquid, if needed that second developing agent can be present in the photographic material. Thanks to this feature a particular important object of the present invention is realized, namely providing an ecologically safe solution which can be easily disposed of after use. As stated above depleted conventional developers containing p-hydroxybenzenes, Phenidones and sulphite ions have to be recollected and destroyed by combustion. On the contrary the ascorbic acid derivative present in developers of the invention could be recycled for a great part. The remainder in the residual solution can be oxidized e.g. by air bubbling; in this way the pH can be decreased below 9.0 and the residual solution can be discharged into the public sewerage.

The developing solutions of the present invention can be employed to develop various types of photographic black-and-white materials, e.g. amateur and professional materials for still photography, radiographic recording and duplicating materials, cinematographic recording and duplicating materials, and microfilm. However the merits of the present invention become most obvious in developing camera or duplicating materials for graphic arts in view of the importance of exact reproduction of line edge and screen dot originals.

The emulsions present in these photographic materials can be of any halide composition, e.g. bromide, chloride, chlorobromide, iodobromide and chloroiodobromide emulsions. The emulsions can belong to the negative working type or to the direct positive type, e.g. the externally fogged type or the unfogged type requiring a fogging agent in the material or in the developing solution. The best results are obtained however when applicating the developing solutions of the invention on materials containing negative chlorobromide emulsions as is commonly the case in various types of graphic arts materials.

The photographic elements which can be developed by the liquids of the present invention can be composed of one single emulsion layer, as it is the case for many applications, or they can be built up by two or even more emulsion layers. Beside the light sensitive emulsion layer(s) the photographic material can contain several non-light sensitive layers, e.g. a protective layer, one or more backing layers, one or more subbing layers, and one or more intermediate layers, e.g. filter layers.

The emulsions present in the photographic materials which can be developed by the solutions of the present invention can be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners or by means of reductors e.g. tin compounds as described in GB 789,823, amines, hydrazine derivatives, formamidine-sulphinic acids, and silane compounds.

The silver halide emulsions under consideration can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. Infra-red sensitizing dyes and combinations with supersensitizing compounds can be present.

The silver halide emulsions under consideration can be stabilized by representatives of the same chemical classes which can be present in the developing solutions as enumerated above. Other preferred compounds include triazaindenes, tetrazaindenes and pentazaindenes, especially those described by Birr in Z. Wiss. Phot. 47 (1952), pages 2–58.

The gelatin binder of these photographic elements can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum. aldehydes e.g. formaldehyde, glyoxal, and glutaraldehyde, N-methylol compounds e.g. dimethylolurea and methyloldimethylhydantoin, dioxan derivatives e.g. 2,3-dihydroxydioxan, active vinyl compounds e.g. 1,3,5-triacryloylhexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in European Patent Application No 90.201850.6

The photographic elements under consideration may further comprise various kinds of surface-active agents in the photographic emulsion layer or in at least one other hydrophilic colloid layer. Preferred surface-active coating agents are compounds containing perfluorinated alkyl groups.

The photographic elements may further comprise various other additives such as e.g. compounds improving the dimensional stability of the photographic element. UV-absorbers, spacing agents and plasticizers.

As stated above the photographic material can contain several non light sensitive layers. e.g. an anti-stress top layer, one or more backing layers, and one or more intermediate layers eventually containing filter-or antihalation dyes that absorb scattering light and thus promote the image sharpness. Suitable light-absorbing dyes are described in e.g. U.S. Pat. No. 4,092,168. U.S. Pat. No. 4,311,787. U.S. Pat. No. DE 2,453,217. and GB 7 907 440. One or more backing layers can be provided at the non-light sensitive side of the support. These layers which can serve as anti-curl layer can contain e.g. matting agents like silica particles, lubricants, antistatic agents light absorbing dyes, opacifying agents, e.g. titanium oxide and the usual ingredients like hardeners and wetting agents.

The support of the photographic material may be opaque or transparent, e.g. a paper support or resin support. When a paper support is used preference is given to one coated at one or both sides with an Alpha-olefin polymer, e.g. a polyethylene layer which optionally contains an anti-halation dye or pigment. It is also possible to use an organic resin support e.g. cellulose nitrate film, cellulose acetate film, polyvinylacetal film, polystyrene film, polyethylene terephthalate film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material to be developed by the solutions of the present invention can be image-wise exposed by any convenient radiation source in accordance with its specific application.

For processing preferably an automatically operating apparatus is used provided with a system for automatic replenishment of the processing solutions. The developing solution according to the invention has to be replenished not only for decrease of the liquid volume due to cross-over into the next processing solution but also for pH decrease due to oxidation of the ascorbic acid derivative molecules. This can be done on a regular time interval basis. e.g. on a daily basis or can be monitored automatically by a permanent pH measuring system.

The development step can be followed by a washing step, a fixing solution and another washing or stabilization step. Finally the photographic material is dried. The first washing step can be omitted if wanted.

The following examples illustrate the invention without however limiting it thereto.

EXAMPLE 1

A typical graphic arts chlorobromide emulsion was prepared by a double jet technique. The silver halide composition was 83.6 mole % of chloride, 16 mole % of bromide and 0.4 mole % of iodide, and the average grain size was 0.27 micron. After addition of inert gelatin the emulsion was chemically ripened to an optimal fog-sensitivity relationship and then spectrally sensitized to the blue and the green spectral region.

Finally the emulsion was stabilized by means of 4-hydroxy-6-methyl-1,3,3a,7-tetraazaindene. After addition of a conventional coating aid and a conventional hardener the emulsion was coated on one side of a tranparent polyethylene terephtalate support at a silver coverage of 6.25 g/m$^2$, expressed as $AgNO_3/m^2$.

Dried coated samples of the prepared photographic material were exposed by a conventional white light source, on the one hand through a continuous tone wedge, on the other hand through a contact screen with a ruling of 54 lines/cm combined with a continuous tone wedge.

Then these samples were developed on the one hand by means of a solution according to the invention (A) and on the other hand by means of a conventional hydroquinone-Phenidone control solution (B). The composition of the two developers is given in table 1:

TABLE 1

| ingredient | Solution A | solution B |
|---|---|---|
| ascorbic acid | 150 g | — |
| potassium bromide | 25 g | 10 g |
| 1-phenyl-5-mercaptotetrazole | 0.08 g | 0.03 g |
| hydroquinone | — | 20 g |
| Phenidone | — | 0.5 g |
| potassium carbonate | — | 24 g |
| potassium sulphite | — | 65 g |
| potassium hydroxide to establish a pH of | 12.35 | 10.5 |
| water to make | 1 l | 1 l |

The sensitometric values and screen dot quality ratings after development in solutions A and B at 32° C. are represented in table 2.

TABLE 2

| Sol. | dev. time | fog | S[1] | grad(t)[2] | grad[3] | dot rating[4] |
|---|---|---|---|---|---|---|
| A | 20 s | 0.04 | 105 | 5.3 | 10 | 2 |
| A | 30 s | 0.05 | 123 | 7.0 | 22 | 1.5-2 |
| A | 40 s | 0.05 | 132 | 8.9 | 29 | 1.5 |
| A | 50 s | 0.06 | 138 | 7.2 | 30 | 1.5 |
| B | 20 s | 0.03 | 95 | 3.3 | 10 | >4 |
| B | 30 s | 0.03 | 100 | 3.3 | 11 | 3.5 |
| B | 40 s | 0.03 | 100 | 3.3 | 11 | 3 |
| B | 50 s | 0.03 | 102 | 3.3 | 11 | 3 |

Notes:
[1]S: sensitivity measured at density 2.00 + fog and expressed as relative arithmetic value whereby the sensitivity for 30 seconds development in developer B is arbitrary set to 100; higher value means higher sensitivity;
[2]grad(t).: gradation in the toe of the sensitometric curve measured between densities 0.1 and 0.5;
[3]grad.: gradation measured between densities 1.0 and 3.0;
[4]dot quality rating expressed in arbitrary units ranging from 0 (best) to 5 (worst); the values are averages of the ratings for a 10%, a 50% and a 90% dot.

The results of table 2 clearly demonstrate the steeper gradation and the better dot quality ratings obtained with the developing solution (A) according to the invention.

EXAMPLE 2

A developing solution according to the invention (C) and control prior art solution (D) according to Zwicky's formula were prepared showing following compositions (table 3):

TABLE 3

| ingredient | solution C | solution D |
|---|---|---|
| potassium bromide | 25 g | 18.8 g |
| ascorbic acid | 150 g | 112.5 g |
| 1-phenyl-5-mercaptotetrazole | 0.1 g | — |
| formaldehyde sodiumbisulphite | — | 37.5 g |
| potassium hydroxide to establish a pH of | 12.35 | 10.5 |
| water to make | 1 l | 1 l |

Table 4 summarizes the sensitometric results and dot quality ratings at different development times at 32° C.

TABLE 4

| Sol. | dev. time | fog | S | grad(t) | grad | dot rating |
|---|---|---|---|---|---|---|
| C | 20 s | 0.05 | 91 | 6.2 | 20 | 1.5 |
| C | 40 s | 0.08 | 105 | 8.1 | 32 | 1.5 |
| C | 60 s | 0.10 | 115 | 9.3 | 27 | 1.5 |
| D | 60 s | 0.03 | 72 | 4.5 | — | 3.5 |
| D | 90 s | 0.04 | 93 | 4.8 | 14 | 3-3.5 |

TABLE 4-continued

| Sol. | dev. time | fog | S | grad(t) | grad | dot rating |
|---|---|---|---|---|---|---|
| D | 120 s | 0.06 | 91 | 4.6 | 17 | 3-3.5 |

Table 4 clearly illustrates the better gradations and dot quality ratings reached at shorter developing times by means of the developer according tot he invention compared to Zwicky's formula.

EXAMPLE 3

Samples of the same graphic arts material as in example 1 were exposed in the same way and developed at 32° C. in developers (E) and (F) differing only in pH value with a composition represented in table 5:

TABLE 5

| ingredient | solution E | solution F |
|---|---|---|
| sodium iso-ascorbate.$H_2O$ | 184 g | = |
| potassium bromide | 25 g | = |
| 1-phenyl-5-mercaptotetrazole | 0.08 g | = |
| potassium hydroxide to establish a pH of | 11.75 | 12.35 |
| water to make | 1 l | = |

The sensitometric results and the dot quality ratings are summarized in table 6:

TABLE 6

| Sol. | dev. time | fog | S | grad(t) | grad | dot rating |
|---|---|---|---|---|---|---|
| E | 20 s | 0.03 | 83 | 4.1 | 9.3 | 3 |
| E | 30 s | 0.03 | 93 | 4.7 | 11 | 2.5 |
| E | 40 s | 0.03 | 98 | 4.4 | 13 | 2.5 |
| E | 50 s | 0.03 | 100 | 4.5 | 18 | 2.5 |
| E | 60 s | 0.03 | 102 | 4.6 | 21 | 2.5 |
| F | 20 s | 0.03 | 98 | 6.0 | 9.5 | 2 |
| F | 30 s | 0.04 | 129 | 8.4 | 24 | 1.5 |
| F | 40 s | 0.04 | 135 | 9.0 | 40 | 1.0 |
| F | 50 s | 0.05 | 138 | 9.8 | 42 | 1.0 |
| F | 60 s | 0.05 | 145 | 9.6 | 48 | 1.0 |

The results presented in table 6 illustrate clearly the favourable influence of a pH higher than 12 according to the invention on the gradation and dot quality rating. At the same time this example illustrates the usefullness of iso-ascorbate as an alternative developing agent.

EXAMPLE 4

The same graphic arts material as in previous examples was again exposed in the same way and developed for 20 seconds at 32° C. in developers (G), (H) and (I) differing only in pH value with a composition represented in table 7:

TABLE 7

| ingredient | sol. G | sol. H | sol. I |
|---|---|---|---|
| ascorbic acid | 110 g | = | = |
| potassium bromide | 25 g | = | = |
| 1-phenyl-mercaptotetrazole | 0.08 g | = | = |
| sodium hydroxide to establish a pH of | 11.5 | 12.0 | 13.0 |
| water to make | 1 l | = | = |

The sensitometric results and dot ratings are summarized in table 8.

TABLE 8

| Sol. | pH | fog | S | grad(t) | grad | dot rating |
|---|---|---|---|---|---|---|
| G | 11.5 | 0.04 | 79 | 3.4 | —(1) | 4 |
| H | 12.0 | 0.04 | 105 | 3.9 | 15 | 3 |

TABLE 8-continued

| Sol. | pH | fog | S | grad(t) | grad | dot rating |
|---|---|---|---|---|---|---|
| I | 13.0 | 0.12 | 138 | 9.4 | 16 | 1.5 |

Note: (1)density 3.0 was not reached.

This example like the previous one illustrates the effect of pH on the gradation and dot rating.

EXAMPLE 5

A series of developing solutions varying only in ascorbic acid concentration were prepared (see table 9); the rest of the composition was the same as in solution (H) of example 4 (pH=12.0).

TABLE 9

| solution | conc. ascorbic acid |
|---|---|
| J | 20 g/l |
| K | 35 g/l |
| L | 71 g/l |
| M | 110 g/l |
| N | 150 g/l |

The same graphic arts material as in the previous examples was exposed in the same way and developed for 40 seconds at 35° C. with solutions (J) to (N). Table 10 summarizes the sensitometric results and the dot quality ratings.

TABLE 10

| Sol. | fog | S | grad(t) | grad | dot rating |
|---|---|---|---|---|---|
| J | 0.03 | — | 2.7 | — | 5 |
| K | 0.03 | — | 3.4 | | >4 |
| L | 0.04 | 112 | 4.7 | 16 | 3 |
| M | 0.04 | 112 | 5.1 | 20 | 3 |
| N | 0.16 | 126 | 8.2 | 21 | 2.5 |

The results illustrate clearly the effect of an increasing concentration of ascorbic acid on the gradation and dot quality rating. At pH 12.0 which is the minimal value according to of the present invention a concentration of more than 70 g/l ascorbic acid corresponding to 0.4 mole/l was needed to obtain an acceptable result.

We claim:

1. Photographic developing solution for immersion development showing a pH of at least 12.0 and containing more than 0.45 moles/liter of a sugar derivative, or an alkali metal salt thereof, corresponding to general formula (I):

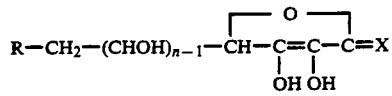

(I)

wherein X represents an oxygen atom or an imino group, and n represents a positive integer from 1 to 4, and R represents a hydroxy group when n is 1, and R represents a hydroxy group or a hydrogen atom when n is 2 to 4.

2. Photographic developing solution according to claim 1 wherein said sugar derivative is l-ascorbic acid or iso-ascorbic acid.

3. Photographic developing solution according to claim 1, wherein the concentration of said sugar derivative is comprised between 0.45 and 0.90 moles per liter.

4. Photographic developing solution according to claim 1, wherein the pH ranges from 12.3 to 13.5.

5. Photographic developing solution according to claim 1, which contains no substantial amount of another developing agent.

6. Photographic developing solution according to claim 1, which contains no substantial amount of sulphite ions.

7. Photographic developing solution according to claim 1, which further contains an alkali bromide in a concentration ranging from 0.1 to 0.4 moles per liter.

8. Photographic developing solution according to claim 1, which further contains a heterocyclic stabilizer.

9. Photographic developing solution according to claim 8 wherein said heterocyclic stabilizer in a mercapto-group containing heterocyclic stabilizer.

10. Photographic developing solution according to claim 9 wherein said heterocyclic stabilizer containing a mercapto-group is 1-phenyl-5-mercaptotetrazole and said stabilizer is present in a concentration ranging from 20 to 250 mg/l.

11. Method for developing an image-wise exposed photograpic material comprising the steps of immersing said material in a photographic developing solution according to claim 1.

12. Method according to claim 11 wherein said photographic material is a graphic arts material containing a chlorobromide emulsion.

13. Method according to claim 11, wherein the concentration of said sugar derivative and the pH is maintained at a constant value by replenishment.

* * * * *